United States Patent [19]

Braunroth

[11] Patent Number: 4,503,851

[45] Date of Patent: Mar. 12, 1985

[54] DISPOSABLE FACE MASK WITH ODOR MASKING ATTACHMENT

[76] Inventor: Klaus Braunroth, 545-C 12th Ave., Hickory, N.C. 28601

[21] Appl. No.: 520,604

[22] Filed: Aug. 5, 1983

[51] Int. Cl.[3] ..... A62B 7/00

[52] U.S. Cl. ..... 128/203.29; 128/204.13; 128/206.19; 2/171.2

[58] Field of Search ..... 128/203.29, 204.13, 128/206.19, 206.21, 206.28, 203.12, 206.12; 2/171.2, 173, 206

[56] References Cited

U.S. PATENT DOCUMENTS

| | | | |
|---|---|---|---|
| 218,976 | 8/1879 | Hurd | 128/206.17 |
| 706,015 | 8/1902 | Breen | 128/206.17 |
| 2,615,754 | 10/1952 | Lindenberg | 299/24 |
| 4,271,834 | 6/1981 | Tanaka | 128/203.29 |
| 4,277,024 | 7/1981 | Spector | 239/36 |

FOREIGN PATENT DOCUMENTS

| | | | |
|---|---|---|---|
| 672254 | 5/1952 | United Kingdom | 128/204.13 |

*Primary Examiner*—Henry J. Recla

*Attorney, Agent, or Firm*—W. Thad Adams, III

[57] ABSTRACT

A mask (10) is disclosed including a cone-shaped cover (11) and an envelope (20) positioned on the envelope (11). The envelope (20) contains a mass of absorbant material (25) which is saturated with an odor-masking substance (26). One embodiment of the invention includes an inside seal (28) and an outside seal (29). By removing both seals air is permitted to be drawn directly through envelope (20) where it mixes with the odor-masking substance (26) and is drawn into the mask. Another embodiment of the invention includes an envelope (50) having a face (**52*b*) perforated with a plurality of apertures (56). The face (52*b*) is overlaid with a seal (60) which is removed when the mask is used. The odor-masking substance (55) is drawn through apertures (56), mixes with air and is drawn back through the mask (40**).

3 Claims, 7 Drawing Figures

DISPOSABLE FACE MASK WITH ODOR MASKING ATTACHMENT

TECHNICAL FIELD AND BACKGROUND OF THE INVENTION

This invention relates to a disposable face mask of the type adapted to be fitted over the nose and mouth of the wearer and held in place by a strand around the head. The general type of face mask disclosed is constructed of a relatively tightly woven cloth or of a molded paper product having efficient air filtration characteristics. Also, the invention disclosed herein is intended primarily for situations where an unpleasant odor is present which can be effectively masked or disguised by another fragrance or aroma, but not in situations where the atmosphere may contain poisonous, toxic, or corrosive gases. In the latter situations, a different type of mask is necessary having a canister with an appropriate neutralizing or filtering agent.

Among the general types of uses for which the invention disclosed in this application is useful would be in the presence of animal wastes such as would be found in stockyards, by hospital personnel and by emergency service officers at crime scenes, disaster locations and other areas where decomposed bodies are present. The mask also has application in any commercial or industrial environment where unpleasant odors may be present in the absence of poisonous, toxic or corrosive gases.

The mask is intended to be inexpensive, stored for indefinite periods of time and easily activated when necessary. The mask can be designed to effectively control odors for a specified period of time whereupon the mask is discarded and another one substituted.

In addition, the mask may be adapted to perform an anti-bacterial function depending upon the odor-masking substance selected.

SUMMARY OF THE INVENTION

Therefore, it is an object of the invention to provide a disposable, gas-permeable face mask of the type adapted to be fitted over the nose and mouth of the wearer and held in place by a strand around the head and which includes the improvement comprising odor-masking means adapted to be activated when the mask is placed into use.

It is another object of the invention to provide a disposable, gas-permeable face mask having an envelope secured thereto, which envelope contains a supply of volatile odor-masking substance which is sealed to prevent dissipation until the mask is ready for use.

It is another object of the present invention to provide a disposable, gas-permeable face mask which includes odor-masking means and which may be stored for an indefinite period of time before use.

It is yet another object of the present invention to provide a disposable, gas-permeable face mask having odor-masking means which are designed to mask odors for a set period of time whereupon the mask is discarded and replaced with another mask.

These and other objects and advantages of the present invention are achieved in the preferred embodiments of the mask below by providing a disposable, gas-permeable face mask of the type adapted to be fitted over the nose and mouth of the wearer and held in place by a strand around the head, and including the improvement which comprises odor-masking means adapted to be activated when the mask is placed in use. The odor-masking means includes an envelope which is impervious to volatile substances and has at least one aperture on one of its faces. The envelope is secured to the mask proximate to the position of the mouth and nose. The envelope contains a supply of a volatile, odor-masking substance and is normally sealed prior to use to prevent dissipation of the odor-masking substance until the mask is ready for use.

When the mask is ready for use, the seal is removed from over the aperture allowing the odor-masking substance to evaporate as the wearer breathes through the mask. The odor-masking substance is mixed with the air and moves into the mask past the aperture and the envelope containing the odor-masking substance. Preferably, the mask defines a hole therein smaller than the peripheral extent of the envelope. The envelope is overlapped with the hole in the mask. The envelope includes a second aperture on a face of the envelope opposite the first aperture and a second seal releasably positioned over the second aperture. Second releasing means cooperate with and permit removal of the second seal to permit passage of air breathed into the mask through the first aperture, through the volatile odor-masking substance, out of the mask through the second aperture and into the interior of the mask.

BRIEF DESCRIPTION OF THE DRAWINGS

Some of the objects of the invention have been set forth above. Other objects and advantages of the invention will appear as the description of the invention proceeds, when taken in conjunction with the following drawings, in which.

DESCRIPTION OF THE PREFERRED EMBODIMENT

Figure 1:
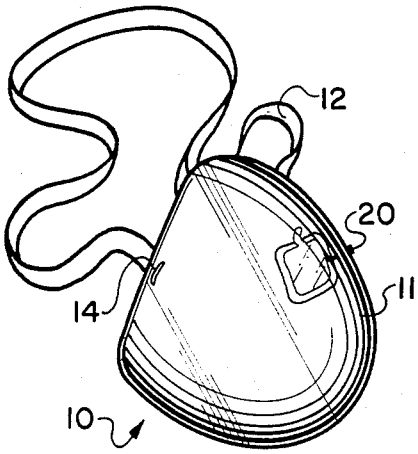
FIG. 1 is a perspective view of a mask according to one preferred embodiment of the invention.
Figure 2:
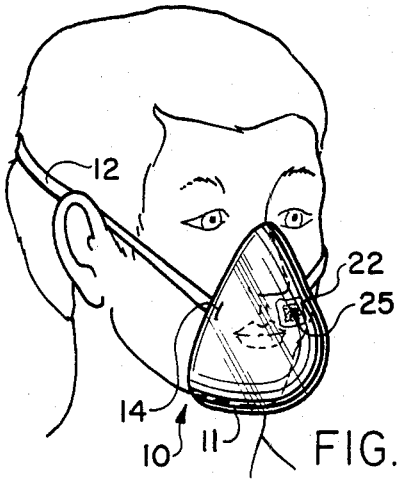
FIG. 2 is a perspective view of the embodiment shown in FIG. 1 in place on a wearer.

Referring now specifically to the drawings, a preferred embodiment of the mask is shown in FIG. 1 and designated generally at reference numeral 10. Mask 10 comprises a generally cone-shaped cover 11, the peripheral edge of which is intended to fit closely against the surface of the face and enclose the nose and mouth of the wearer (see FIG. 2). Cover 11 of mask 10 is held in position around the face by means of an elastic strap 12 which is secured to opposite sides of cover 11 with, for example, a staple or stitching 14.

Odor-masking means is generally indicated at reference numeral 20 in FIG. 1. The odor-masking means 20 is constructed as follows:

A hole 21 is first cut in the mask proximate to the position of the mouth and nose. An envelope 22 formed of a material such as foil-backed plastic which is impervious to volatile substances is secured by stitches 24 to the mask in overlapping relationship to hole 21. Positioned within envelope 22 is a mass of absorbant material 25, such as cotton, which is saturated with an odor-masking substance 26 typically a fragrant chemical dissolved in a suitable solvent. In cases where slow evaporation is required so that the mask will effectively disguise odors for a substantial period of time, the odor-masking substance may be dissolved in a viscous liquid, such as glycerine, to retard the rate of evaporation.

Figure 3:
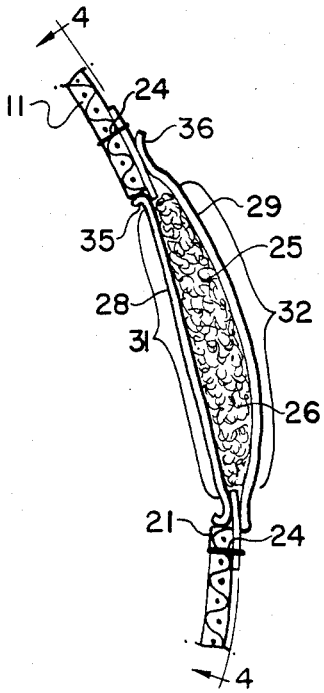
FIG. 3 is a cross-section through the central portion of the mask shown in FIGS. 1 and 2.

As can best be seen in FIG. 3, envelope 22 overlaps hole 21 in order to provide a surface through which stitches 24 can be placed. Also note that the envelope 24 extends inwardly into the plane defined by hole 21. This portion of envelope 22 defines a surface on either side thereof where an inside seal 28 and an outside seal 29 may be attached. Seals 28 and 29 normally provided with an adhesive on their inner peripheries and are sealingly positioned in overlapping relation on either side of envelope 22.

Envelope 22 therefore defines two apertures, an inner aperture 31 and an outer aperture 32 which is then enclosed respectively by seals 28 and 29. Seals 28 and 29 therefore enclose apertures 31 and 32 and the hole 21 in mask cover 11. As can be seen by continued reference to FIG. 3, the absorbant material 25 is therefore completely enclosed and the odor-masking substance is prevented from evaporating.

Just prior to use and before being placed on the face, the seals are removed by means of releasing means which, in FIG. 3, comprise outwardly extending, free tabs 35 and 36, respectively, on seals 28 and 29. For example, by grasping tab 36 and pulling downwardly, the adhesive on the inner surface of seal 29 is disengaged from envelope 22. Once seal 29 is removed, the absorbant material 25 is exposed on both the inside and outside of the mask. In this way, as the wearer breathes, air is drawn in through hole 21 and absorbant material 25 to the interior of the mask, thereby disguising any unpleasant odors that are present.

Figure 4:
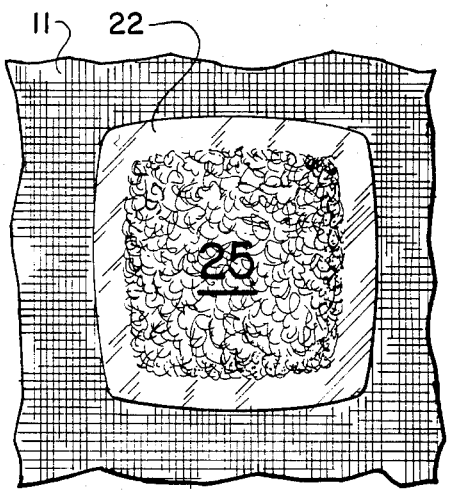
FIG. 4 is a cross-section taken substantially along lines 4—4 of FIG. 3.

FIG. 4 shows a cross-sectional view showing the outer peripheral edge of envelope 22 with the mass of absorbant material 25 positioned therein.

If a less concentrated mixture of air and odor-masking substance is desired, either seal 28 or seal 29 may be left in place. In either case, air enters the mask through the structure of the mask itself and mixes with the odor-masking substance outside the mask if seal 29 is removed, or inside in the mask if seal 28 is removed.

Figure 5:
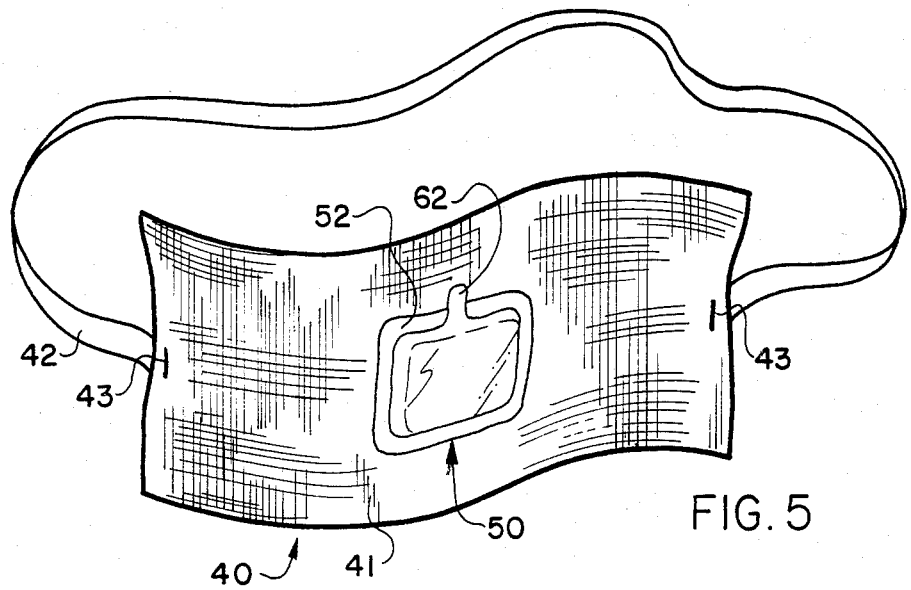
FIG. 5 is a persective view of another preferred embodiment of the mask according to this invention.

Another construction is shown in FIG. 5. The particular type of mask shown in FIG. 5 is generally designated at reference numeral 40 and comprises a woven fabric cover 41 which is relatively densely woven but still sufficiently porous to allow the flow of air while performing a filtering effect. Cover 41 is secured around the head of the wearer by means of a strap 42 which is attached, by staples or stitches 43 to other side of cover 41.

Odor-masking means 50 is secured to the central portion of cover 41 as is shown in FIG. 5.

Figure 6:
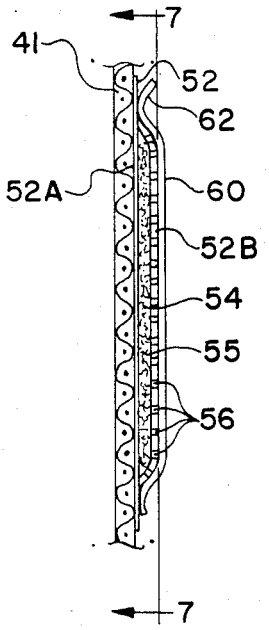
FIG. 6 is a vertical cross-sectional view taken through the central portion of the mask shown in FIG. 5; and, FIG. 7 is a cross-sectional view taken substantially along lines 7—7 of FIG. 6.

Referring now to FIG. 6, a cross-section of odor-masking means 50 is shown and includes an envelope 52 which is constructed of some material which is impervious to volatile substances, such as a foil-backed plastic. Envelope 52 is comprised of two spaced-apart faces 52A and 52B. In the space between faces 52A and 52B, a mass of absorbant material 54, such as cotton, is saturated with an odor-masking substance 55. Still referring to FIG. 6, face 52B is perforated with a plurality of apertures 56. Face 52B of envelope 41 is overlaid with a seal 60 which is engaged by adhesives around the entire periphery of envelope 41. Releasing means, comprising a free tab 62 extends upwardly from one edge of seal 60. Just before the mask is placed on the face, tab 62 is pulled downwardly, removing seal 60 from attachment to envelope 41. This exposes wall 52B of envelope 41. The odor-masking substance 55 is now free to evaporate through apertures 56. As air is drawn through the fabric cover 41 of mask 40, it mixes with the evaporating odor-masking substance and disguises whatever odor may be present.

Figure 7:
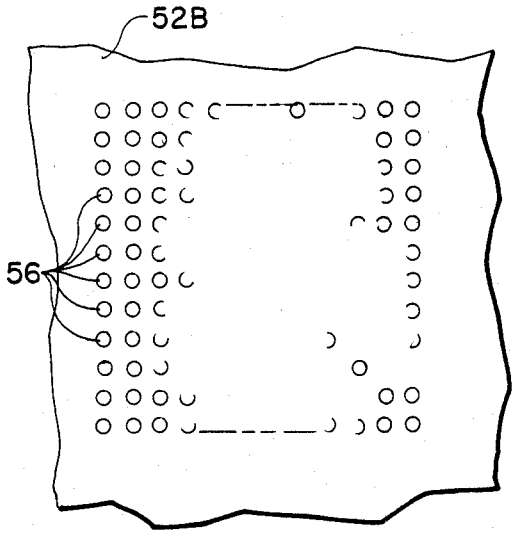

As will be appreciated by comparing the structure disclosed in FIGS. 1 through 4 with that disclosed in FIGS. 5 through 7, the latter construction is simpler and less expensive to construct. However, it should be noted that either construction of the odor-masking structure itself may be used on either the molded paper mask 10 shown in FIG. 1 or the fabric mask 40 shown in FIG. 5. In either case, as the odor-masking substance is dissipated, the mask may be removed, discarded and another identical mask substituted after removing the seal to permit the odor-masking substance to begin evaporating.

A disposable face mask is described above. Various details of the invention may be changed without departing from its scope. Furthermore, the foregoing description of a preferred embodiment of the apparatus and method according to the present invention is provided for the purpose of illustration only and not for the purpose of limitation—the invention being defined by the claims.

I claim:

1. In a disposable, gas-permeable mask of the type adapted to be fitted over the nose and mouth of the wearer and held in place by a strand around the head, the improvement which comprises odor-masking means adopted to be activated when the mask is placed into use, and including:

(a) an envelope which is impervious to volatile substances and having at least one aperture on a face thereof, said envelope being secured to the mask proximate to the position of the mouth and nose;

(b) a supply of volatile odor-masking substance contained within said envelope;

(c) a seal releasably positioned over said aperture to prevent dissipation of the odor-masking substance until the mask is ready for use and the seal is removed;

(d) releasing means cooperating with said seal for removing said seal to permit evaporation of the odor-masking substance as the wearer breathes through the face mask and air is moved into the mask past the aperture and the envelope containing the odor-masking substance.

2. In a disposable face mask according to claim 1, wherein said envelope is secured to the outer surface of the mask and wherein said aperture is positioned in the face of the envelope remote from said mask and is adapted to permit mixing of the odor-masking substance and air outside the mask before it is breathed into the mask through the structure thereof.

3. In a disposable face mask according to claim 1 and further including:

(a) said mask defining a hole therein smaller than the peripheral extent of said envelope;

(b) means sealingly overlapping said envelope with said hole;

(c) a second aperture on a face of said envelope opposite the first aperture and in at least partial registration with the hole in said mask;

(d) a second seal releasably positioned over said second aperture;

(e) second releasing means cooperating with said second seal for permitting removal of said second seal to permit passage of air breathed into the mask to pass through said first aperture, through the volatile odor-masking substance, out of the mask through said second aperture and into the interior of the mask in the vicinity of the nose and mouth of the wearer.

* * * * *